US005832341A

United States Patent [19]

Facci et al.

[11] Patent Number: 5,832,341

[45] Date of Patent: Nov. 3, 1998

[54] CAPTURE OF PAPER MOISTURE FOR AQUATRON REPLENISHMENT

[75] Inventors: John S. Facci, Webster; Joseph Mammino, Penfield; Michael J. Levy, Webster, all of N.Y.

[73] Assignee: Xerox Corporation, Stamford, Conn.

[21] Appl. No.: 4,538

[22] Filed: Jan. 8, 1998

[51] Int. Cl.[6] ..... G03G 21/20

[52] U.S. Cl. ..... 399/97; 399/174; 399/320; 361/225

[58] Field of Search ..... 399/168, 174, 399/320, 322, 328, 330, 97; 361/214, 220, 225, 226; 219/216

[56] References Cited

U.S. PATENT DOCUMENTS

| | | | |
|---|---|---|---|
| 3,848,988 | 11/1974 | Thettu et al. | 399/97 |
| 4,424,552 | 1/1984 | Saint Marcoux | 361/306 |
| 4,745,432 | 5/1988 | Langdon | 399/250 |
| 4,766,462 | 8/1988 | Dyer et al. | 399/250 |
| 5,223,902 | 6/1993 | Chodak et al. . | |
| 5,510,879 | 4/1996 | Facci et al. . | |

*Primary Examiner*—Matthew S. Smith
*Attorney, Agent, or Firm*—Tamera Fair; Arnette Bade

[57] ABSTRACT

An apparatus, printing machine and method for replenishing an aquatron liquid reservoir in an aquatron charging device. The print media (e.g. paper, vellum, etc.) releases liquid from the print media during fusing. A condenser creates condensate from the liquid released by the print media which is collected in a conduit and transported using air flow into a collection container. This collection container can be the aquatron liquid reservoir, or a separate collection container that pumps liquid to the aquatron liquid reservoir, thus, enabling replenishing the liquid supply of the aquatron liquid reservoir within the printing machine. Sensing devices measuring liquid concentration resistance in the aquatron liquid reservoir and/or the collection container control the liquid level of the reservoir and/or collection container.

22 Claims, 4 Drawing Sheets

CAPTURE OF PAPER MOISTURE FOR AQUATRON REPLENISHMENT

BACKGROUND OF THE INVENTION

This invention relates generally to an electrostatographic printer and copier, and more particularly, concerns an apparatus for enabling ion transfer via ionic conduction through an ionically conductive liquid, primarily for use in electrostatographic applications, for example, for charging an imaging member such as a photoreceptor or a dielectric charge receptor.

Generally, the process of electrostatographic reproduction is initiated by exposing a light image of an original document to a substantially uniformly charged photoreceptive member. Exposing the charged photoreceptive member to a light image discharges the photoconductive surface thereof in areas corresponding to non-image areas in the original document, while maintaining the charge on image areas to create an electrostatic latent image of the original. The original is subsequently developed into a visible image by a process in which a charged developing material is deposited onto the photoconductive surface of the photoreceptor. The developing material is attracted to the charged image areas on the photoconductive surface. Thereafter, the developing material is transferred from the photoreceptive member to a copy sheet or some other image support substrate to which the image may be permanently affixed for producing a reproduction of the original document. In a final step in the process, the photoconductive surface of the photoreceptive member is cleaned to remove any residual developing material therefrom in preparation for successive imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images.

Various devices and apparatus have been proposed for use in electrostatographic applications to apply an electrostatic charge or a charge potential to a photoconductive surface prior to the formation of a light image thereon. Typically, corona generating devices are utilized, wherein a suspended electrode comprising one or more fine conductive elements is biased at a high electric potential, causing ionization of surrounding air which results in deposition of an electric charge on an adjacent surface. An example of such a corona generating device is described in U.S. Pat. No. 2,836,725 to R. G. Vyverberg, wherein a conductive corona electrode in the form of an elongated wire is partially surrounded by a conductive shield. The corona electrode is provided with a DC voltage, while the conductive shield is usually electrically grounded. A dielectric surface to be charged is spaced from the wire on the side opposite the shield and is mounted on a grounded substrate. Alternatively, the corona device may be biased in a manner taught in U.S. Pat. No. 2,879,395, wherein an AC corona generating potential is applied to the conductive wire electrode and a DC potential is applied to a conductive shield partially surrounding the electrode. This DC potential regulates the flow of ions from the electrode to the surface to be charged. Because of this DC potential, the charge rate can be adjusted, making this biasing system ideal for self regulating systems. Other biasing arrangements are known in the prior art and will not be discussed in great detail herein.

In addition to charging the imaging surface of an electrostatographic system prior to exposure, corona generating devices, so-called corotrons, can be used in the transfer of an electrostatic toner image from a photoreceptor to a transfer substrate, in tacking and detacking paper to or from the imaging member by neutralizing charge on the paper, and, generally, in conditioning the imaging surface prior to, during, and after the deposition of toner thereon to improve the quality of the xerographic output copy.

Several problems have historically been associated with corona generating devices as described hereinabove. The most notable problem centers around the inability of such corona devices to provide a uniform charge density along the entire length of the corona generating electrode, resulting in a corresponding variation in the magnitude of charge deposited on associated portions of the adjacent surface to be charged. Other problems include the use of very high voltages (6000–8000 V) requiring the use of special insulation, maintenance of corotron wires, low charging efficiency, the need for erase lamps and lamp shields and the like, arcing caused by non-uniformities between the coronode and the surface being charged, vibration and sagging of corona generating wires, contamination of corona wires, and, in general, inconsistent charging performance due to the effects of humidity and airborne chemical contaminants on corona devices. More importantly, corona devices generate ozone, resulting in well-documented health and environmental hazards. Filters are required to remove $O_3$ adding to the cost of the electrostatographic systems. Corona charging devices also generate oxides of nitrogen which eventually desorb from the corotron and oxidize various machine components, thereby adversely effecting the quality of the final output print. The oxides of nitrogen damage the photoreceptor leading to print quality defects such as "parking deletions."

Various approaches and solutions to the problems inherent to the use of suspended wire corona generating charge devices have been proposed. For example, U.S. Pat. No. 4,057,723 to Sarid et al. shows a dielectric coated coronode uniformly supported along its length on a conductive shield or on an insulating substrate. That patent shows a corona discharge electrode including a conductive wire coated with a relatively thick dielectric material, preferably glass or an inorganic dielectric, in contact with or spaced closely to a conductive shield electrode. U.S. Pat. No. 4,353,970 discloses a bare wire coronode attached directly to the outside of a glass coated secondary electrode. U.S. Pat. No. 4,562,447 discloses an ion modulating electrode that has a plurality of apertures capable of enhancing or blocking the passage of ion flow through the apertures. In addition, alternatives to corona generating charging systems have been developed. For example, roller charging systems, as exemplified by U.S. Pat. Nos. 2,912,586 to Gundlach; 3,043,684 to Mayer; 3,398,336 to Martial et al., have been disclosed and discussed in numerous articles of technical literature.

The following disclosures may be relevant to various aspects of the present invention and may be briefly summarized as follows:

U.S. Pat. No. 5,223,902 to Chodak et al. discloses a heat and pressure fuser for fusing toner images on copy media which includes a thin web which is wrapped around a portion of a heated fuser roll to form an extended fusing area. An enclosed cavity is formed beneath the fusing area, the cavity incorporating a moisture collection and removal system. As the copy media passes through the fusing area, its moisture content is vaporized and is condensed within the cavity, collecting in a trough at the bottom of the cavity. The water periodically drains through an outlet drain and is collected in a storage container.

U.S. Pat. No. 4,424,552 to Saint Marcoux discloses a condenser block comprising a stack of insulating layers, separated by metal plates, arranged in relation to one another in such a way that at least part of each metal plate is approximately opposite at least part of another plate, in the direction of stacking, these metal plates forming the condenser plates. In this invention, one metal plate, positioned between any pair of insulating layers, and opposite a second metal plate, placed above the first such plate, between a second pair of insulating layers, faces a third metal plate, also placed above the first plate, between a different pair of insulating layers from the second such pair.

SUMMARY OF INVENTION

Briefly stated, and in accordance with one aspect of the present invention, there is provided an apparatus for replenishing an aquatron liquid reservoir, comprising: a fuser for permanently affixing an image onto a print media; a condenser device for condensing liquid released by the print media during fusing at the fuser; a collection member for collecting the condensing liquid; and a measuring device for determining resistance of a liquid concentration.

Pursuant to another aspect of the present invention, there is provided an electrostatographic printing machine, comprising: a charge retentive surface, capable of movement, advances past a charging station for charging of the charge retentive surface; an exposure station through which the charge retentive surface moves, the charge retentive surface having charged portions being exposed to a scanning device that discharges the charge retentive surface forming a latent image thereon; a development station advances toner particles into contact with the latent image on the charge retentive surface as the charge retentive surface moves through the development station; a transfer station advances a print media for transfer of the toner particles adhered to the latent image onto the print media, the toner particles of the latent image being permanently affixed to the print media via fusing of the latent image of toner particles to the print media; a condenser device for condensing liquid released by the print media during fusing at the fuser; a collection member for collecting the condensing liquid; a measuring device for determining resistance of a liquid concentration; and a cleaning station for removal of the toner particles remaining on the charge retentive surface after transfer.

Pursuant to another aspect of the present invention, there is provided a method for replenishing an aquatron liquid reservoir in a printing machine, comprising the steps of: condensing liquid being released by a print media during fusing by a fuser in the printing machine; collecting the condensing liquid in a collection member; and determining resistance of a liquid concentration in the aquatron liquid reservoir.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
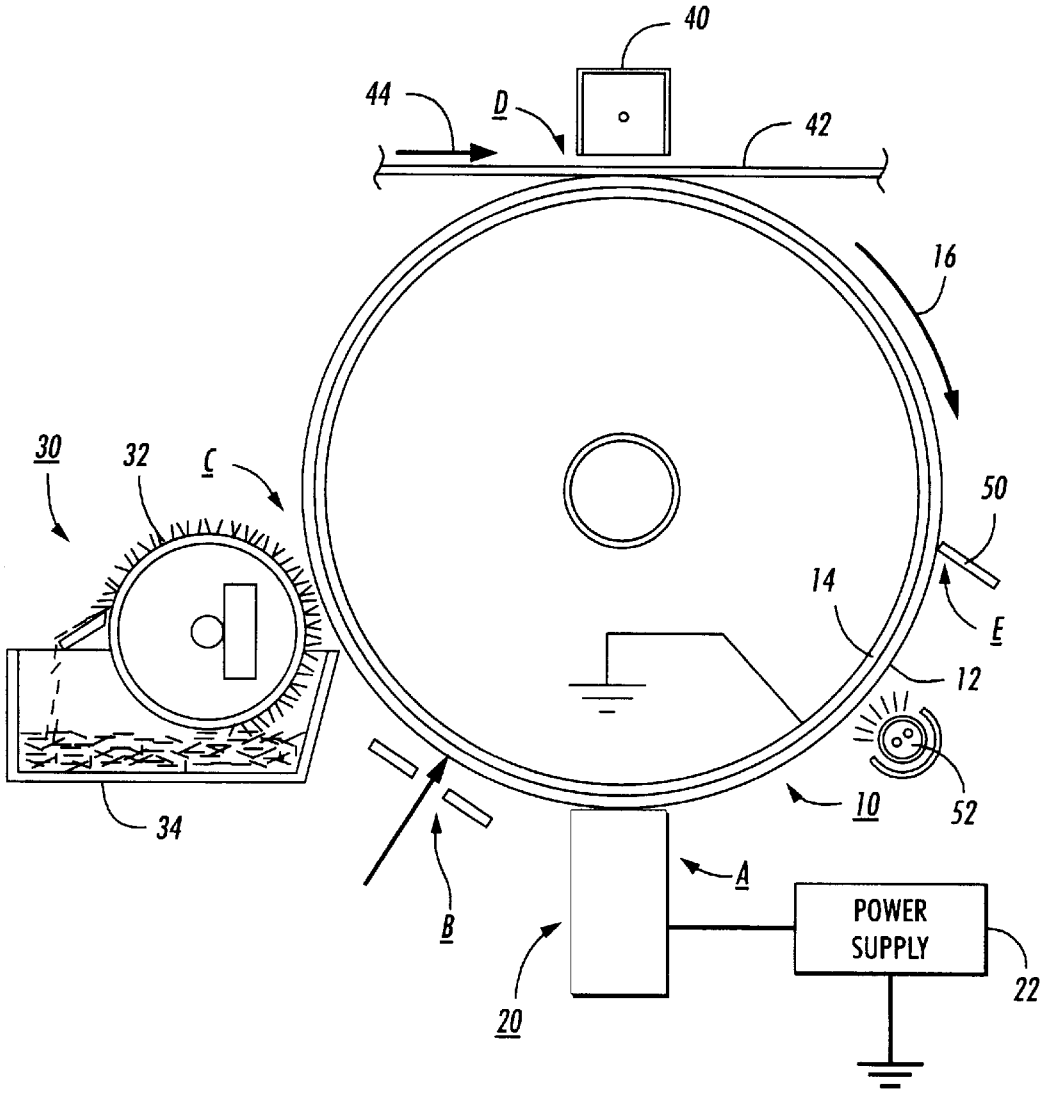
FIG. 5 is a schematic elevational view showing an electrophotographic copier employing the features of the present invention.

For a general understanding of the features of the present invention, reference is made to the drawings wherein like reference numerals have been used throughout to designate identical elements. Referring initially to FIG. 5 prior to describing the invention in detail, a schematic depiction of the various components of an exemplary electrophotographic reproducing apparatus incorporating the fluid media charging structure of the present invention is provided. Although the apparatus of the present invention is particularly well adapted for use in an automatic electrophotographic reproducing machine, it will become apparent from the following discussion that the present fluid media charging structure is equally well suited for use in a wide variety of electrostatographic processing machines and is not necessarily limited in its application to the particular embodiment or embodiments shown herein. In particular, it should be noted that the charging apparatus of the present invention, described hereinafter with reference to an exemplary charging system, may also be used in a transfer, detack, or cleaning subsystem of a typical electrostatographic apparatus since such subsystems also require the use of a charging device.

The exemplary electrophotographic reproducing apparatus of FIG. 5 employs a drum 10 including a photoconductive surface 12 deposited on an electrically grounded conductive substrate 14. A motor (not shown) engages with drum 10 for rotating the drum 10 to advance successive portions of photoconductive surface 12 in the direction of arrow 16 through various processing stations disposed about the path of movement thereof, as will be described.

Initially, a portion of drum 10 passes through charging station A. At charging station A, a charging structure in accordance with the present invention, indicated generally by reference numeral 20, charges the photoconductive surface 12 on drum 10 to a relatively high, substantially uniform potential. This charging device will be described in detail hereinbelow.

Once charged, the photoconductive surface 12 is advanced to imaging station B where an original document (not shown) is exposed to a light source for forming a light image of the original document which is focused onto the charged portion of photoconductive surface 12 to selectively dissipate the charge thereon, thereby recording an electrostatic latent image corresponding to the original document onto drum 10. One skilled in the art will appreciate that a properly modulated scanning beam of energy (e.g., a laser beam) may be used to irradiate the charged portion of the photoconductive surface 12 for recording the latent image thereon.

After the electrostatic latent image is recorded on photoconductive surface 12, drum 10 is advanced to development station C where a magnetic brush development system, indicated generally by the reference numeral 30, deposits developing material onto the electrostatic latent image. The magnetic brush development system 30 includes a single developer roller 32 disposed in developer housing 34. Toner particles are mixed with carrier beads in the developer housing 34, creating an electrostatic charge therebetween which causes the toner particles to cling to the carrier beads and form developing material. The developer roller 32 rotates to form a magnetic brush having carrier beads and toner particles magnetically attached thereto. As the magnetic brush rotates, developing material is brought into contact with the photoconductive surface 12 such that the latent image thereon attracts the toner particles of the developing material, forming a developed toner image on photoconductive surface 12. It will be understood by those skilled in the art that numerous types of development systems could be substituted for the magnetic brush development system shown herein.

After the toner particles have been deposited onto the electrostatic latent image for development thereof, drum 10 advances the developed image to transfer station D, where a sheet of support material 42 is moved into contact with the developed toner image via a sheet feeding apparatus (not shown). The sheet of support material 42 is directed into contact with photoconductive surface 12 of drum 10 in a timed sequence so that the developed image thereon contacts the advancing sheet of support material 42 at transfer station D. A charging device 40 is provided for creating an electrostatic charge on the backside of sheet 42 to aid in inducing the transfer of toner from the developed image on photoconductive surface 12 to a support substrate 42 such as a sheet of paper. While a conventional coronode device is shown as charge generating device 40, it will be understood that the fluid media charging device of the present invention can be substituted for the corona generating device 40 for providing the electrostatic charge which induces toner transfer to the support substrate materials 42. The support material 42 is subsequently transported in the direction of arrow 44 for placement onto a conveyor (not shown) which advances the sheet to a fusing station which permanently affixes the transferred image to the support material 42 creating a copy or print for subsequent removal of the finished copy by an operator.

Invariably, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10. Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp 52 for flooding the photoconductive surface 12 with light in order to dissipate any residual electrostatic charge remaining thereon in preparation for a subsequent imaging cycle. As will be described, the present invention may also be utilized as a substitute for such a discharge lamp to counter any residual electrostatic charge on the photoconductive surface 12.

The foregoing description should be sufficient for purposes of the present application for patent to illustrate the general operation of an electrophotographic reproducing apparatus incorporating the features of the present invention. As described, an electrophotographic reproducing apparatus may take the form of any of several well known devices or systems. Variations of the specific electrostatographic processing subsystems or processes described herein may be expected without affecting the operation of the present invention.

Liquid (e.g. aquatron, as described in U.S. Pat. No. 5,510,879 to Facci et al. and herein incorporated by reference) charging is an ozone-free contact charging technique that is based on electrification of a water (or other liquid) moistened contact pad on the photoreceptor surface. Its advantage over other contact charging techniques in that it provides excellent charging uniformity over a wide range of process speeds, e.g. to at least 50 ips and is DC-only. It is nearly 100% efficient, operating at near theoretical voltage and current levels.

During the fusing of xerographic imaging, paper is heated with the expulsion of water vapor into the machine. In the 3030 and 3050 Xerox engineering copiers the water released from the fusing step is condensed onto a cooling surface and collected in a gallon sized container. In the present invention, a similar condenser is used in order to collect liquid condensate as the supply for an aquatron charging unit, as the liquid in the device is depleted. A commercially available pump and sensor arrangement can be used to indicate when the aquatron needs to be resupplied with liquid.

One of the main objectives of charging with an aquatron (a water based liquid charging device) is the management of the water supply. Evaporation of liquid during "off" times (i.e. machine is non-operable) can be managed by containment of the liquid reservoir and sealing or covering of the exposed moist charging element (applicator) which contacts the surface during the charging step to prevent evaporation of the charging liquid. In practice, a minute quantity of liquid is transferred to the photoreceptor during charging. Also some evaporation from the exposed applicator surfaces during charging is also unavoidable. At an experimentally determined depletion rate of about 1 microliter per page, 100 cc of water is consumed per 100,000 copies. While the depletion of water can be maintained at this or a lower level, it would be desirable to replenish water from time to time in order to extend the life of the device, especially if the process were not obvious to the customer to avoid customer/user intervention.

Figure 1:
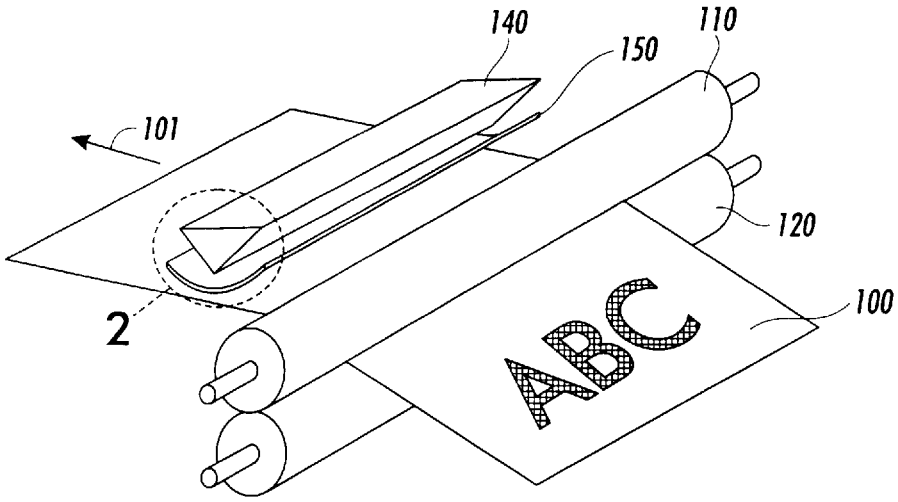
FIG. 1 is an elevational schematic view of water condensing for transferring moisture condensate from fused paper to an aquatron reservoir.

In certain applications it is undesirable to expect the customer to replenish the liquid supply either because of the inconvenience or added supplies cost. By using an inherent supply of liquid (e.g. water) in the printer/copier, namely the liquid (e.g. water) vapor which is released from paper during the fusing step, the inconvenience and added cost, mentioned above, are prevented. In some copiers, the quantity of liquid which is expelled from paper is substantial. In the 3030 and 3050 Xerox engineering copiers, a gallon sized container is provided to capture the moisture vapor which is condensed onto a cooling surface. The surfaces onto which the vapor condenses are at the nominal internal temperature of the machine (about 40° C.) and are not intentionally cooled. In the present invention, the moist air in the vicinity of the fuser is directed against such a condensing surface described above, in order to collect the moisture escaping from paper during fusing into liquid. The liquid is then drained into a sump. A schematic diagram of the present invention is shown in FIG. 1. An interesting advantage of this process is that it produces distilled liquid (e.g. water). Antibiotic, anti-fungal and other additives may be added to the liquid collection sump to keep the liquid free of organic growths and odors while in storage before dispensing to the aquatron.

Figure 2:
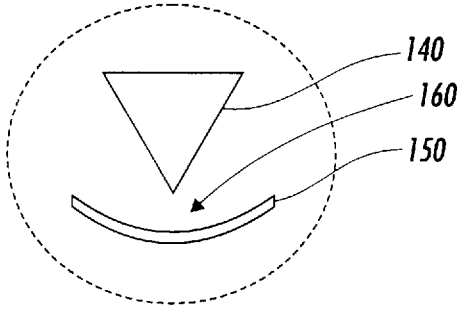
FIG. 2 is a magnification of 2 in FIG. 1.

FIG. 1 shows an elevational schematic of liquid condensing. In the present invention moisture condensate is transferred from fused paper 100 to an aquatron reservoir. A print media 100 passes in between a fuser roll 110 and a back up roll 120. The direction of motion of the print media 100 is shown by arrow 101. The liquid condensing apparatus of the present invention is indicated by the magnification circle referencing FIG. 2. In FIG. 2, air flow 160 occurs between the solid or hollow condenser block 140 and the liquid collection conduit or trough 150. The air flow 160 transports the condensate along the conduit 150 to a collection container or sump 180 (see FIG. 3).

Figure 3:
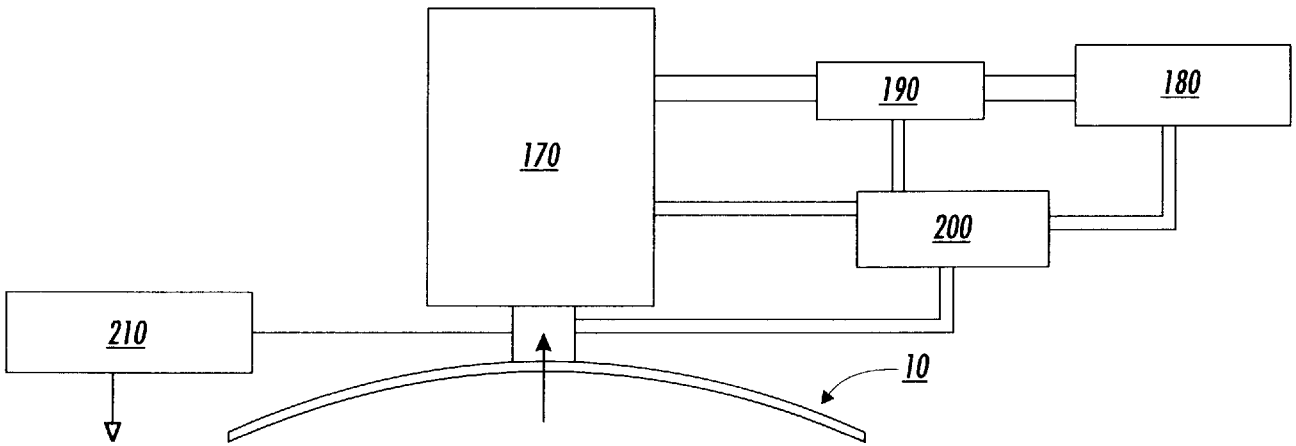
FIG. 3 is a schematic of a circuit for controlling pumping of liquid from the sump to the aquatron.

FIG. 3 shows a block diagram of an integrated system for sensing the need for liquid and transferring the moisture condensate from a collection vessel (sump) 180 to the aquatron reservoir 170 via an inexpensive pump 190 that is currently used in the Xerox 3050 engineering copier to pump silicone oil. (It is also noted that the collection vessel could also be the aquatron reservoir, thus, eliminating the cost of a separate collection vessel and the step of moving the liquid to the aquatron reservoir 170 from the collection vessel 180.) A sensor or series of sensors 200 based on the measurement of resistance is used to indicate when the liquid concentration in the reservoir 170 or at the applicator medium contacting the image receptor reaches some lower critical threshold. The pump 190 is triggered on when either a sensor located in the water reservoir 170 or on the applicator reads a resistance higher than a threshold resistance. Testing has found that a value of about 1–2 Megohms (MΩ) is a good threshold. A resistance higher than this value indicates the need for replenishment of the aquatron. A similar sensor located in the sump is used to confirm that water is present in the sump when needed. A high voltage DC power supply 210 can be used for this apparatus. This power supply provides the high voltage to charge the photoreceptor.

In some cases it is neither an inconvenience nor an excessive expense to the customer to add liquid directly to the sump, i.e. an external reservoir (see U.S. patent application Ser. No. 08/974,099 (attorney's Docket No. D/97192). The system shown in FIG. 3 automatically monitors the correct level or concentration of liquid in the internal aquatron reservoir, the resistance of the liquid applicator and the presence of liquid in the sump when needed.

In addition, the aquatron can be miniaturized to fit into confined areas. In these situations the engine design of the printer/copier could take advantage of the small footprint capability of the aquatron. This arrangement likely requires a remotely located source of liquid. The sensing and pumping arrangement of FIG. 3 could therefore be used to supply liquid as needed to a miniature aquatron.

Figure 4:
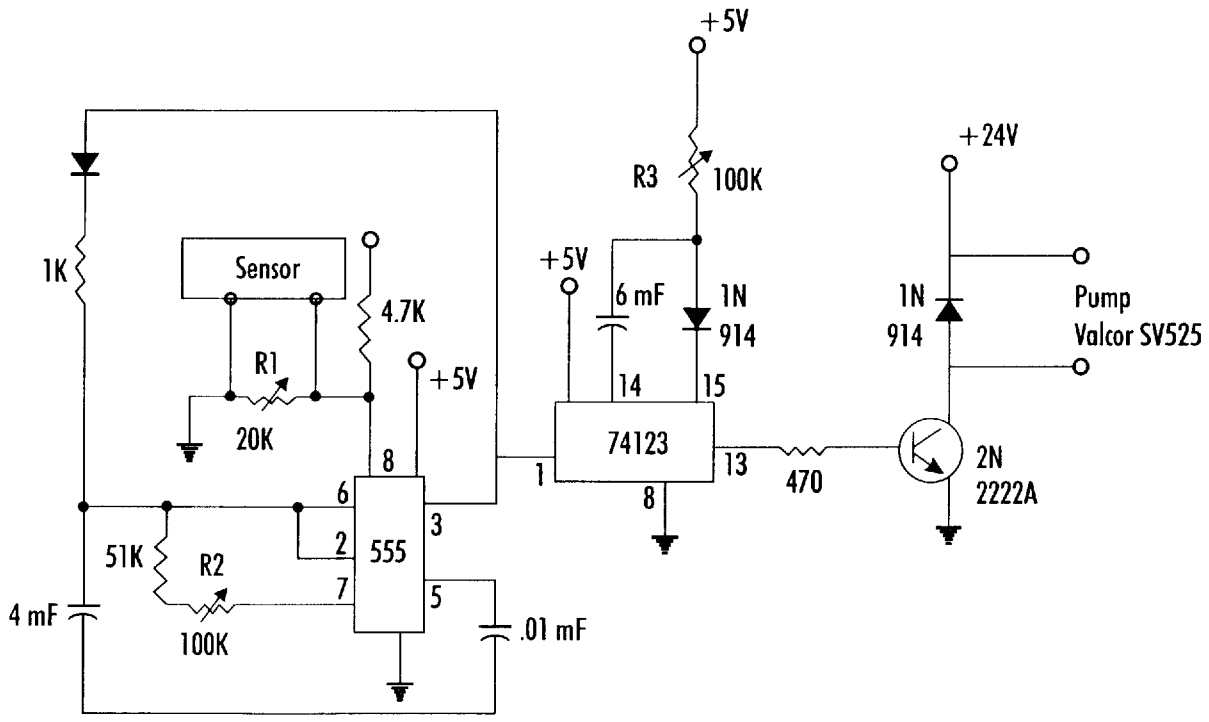
FIG. 4 is a schematic of a sensor/control circuit for sensing liquid supply and controlling pumping of liquid from the sump to the aquatron.

A sensor or series of sensors based on the measurement of resistance can be used to indicate when the liquid or fluid concentration in the reservoir or a moist wick (i.e. an open cell foam or a bundle of fibers loosely twisted, braided or woven cord, tape or tube that by capillary action draws up a steady supply of charging liquid to the charging unit) reaches some lower critical threshold. The sensor/control circuit shown in FIG. 4 was tested. When the application medium, in this cae PVA (poly vinyl alcohol) foam, dries to below a threshold water concentration, corresponding to a foam resistance of about 1 Megohm (MΩ), the pump is turned on and water (e.g. liquid) from the sump is pumped into the reservoir. A commercially available pump which is used to pump silicone oil in reprographic equipment is used. The threshold resistance of the sensor is controlled by resistor 1 (R1). The pumping rate (number of strokes per second) is controlled by resistor 2 (R2) and the stroke length (volume of water pumped per stroke) is controlled by resistor 3 (R3). A slow pumping rate is desirable so that the applicator has time to become rewet, but not overshoot the correct wetness. By placing additional sensors in series with different set points the circuit can be made to shut off the pump when the internal resistance of the reservoir reaches a lower threshold value of about 100 kilohms. A sensor may also signal that the storage capacity of the sump has reached a maximum and should be emptied.

In recapitulation, the present invention utilizes a device for charging photoconductive imaging members by ionic conduction through a fluid media charging device called an aquatron. The aquatron fluid supply must be replenished when the fluid supply decreases. The print media releases liquid from the print media during fusing in the printing machine. A condenser creates condensate from this liquid which is collected in a conduit and transported using air flow into a collection container. This collection container can be the aquatron reservoir or a separate collection container that pumps liquid to the aquatron reservoir, thus, enabling replenishing of the liquid supply of the aquatron reservoir within the printing machine. Sensing devices measuring liquid concentration resistance in the aquatron reservoir and/or the collection container control the liquid level of the reservoir and/or collection container.

It is, therefore, apparent that there has been provided in accordance with the present invention, a method to capture moisture for replenishing the aquatron that satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for replenishing an aquatron liquid reservoir, comprising:

a fuser for permanently affixing an image onto a print media;

a condenser device for condensing liquid released by the print media during fusing at said fuser;

a collection member for collecting the condensing liquid; and a measuring device for determining resistance of a liquid concentration in said collection member.

2. An apparatus as recited in claim 1, wherein said condenser device comprises:

a condensing member;

a conduit device located adjacent to said condensing member to enable capture of condensed liquid from said condensing member; and air flow that occurs between said condensing member and said conduit device, said air flow containing the condensed liquid for transport to the collection member.

3. An apparatus as recited in claim 2, wherein said measuring device comprises a sensor.

4. An apparatus as recited in claim 3, wherein said collection member comprises the aquatron liquid reservoir.

5. An apparatus as recited in claim 4, further comprising a pump being connected to said collection member to remove liquid therefrom, said pump being activated when said sensor reads a resistance higher than a threshold resistance.

6. An apparatus as recited in claim 5, wherein said sensor being located in the aquatron liquid reservoir determines when resistance of a liquid concentration therein reaches a lower critical threshold.

7. An apparatus as recited in claim 5, wherein said sensor being located at an applicator medium contacting an image receptor for determining when resistance of a liquid concentration reaches a lower critical threshold.

8. An apparatus as recited in claim 3, wherein said collection member comprises a sump.

9. An apparatus as recited in claim 8, wherein said sensor includes:

a first sensor for determining resistance of liquid concentration in the aquatron liquid reservoir; and a second sensor for determining resistance of liquid concentration in said sump.

10. An apparatus as recited in claim 9, further comprising a pump being connected to said sump and the liquid aquatron to transport liquid to and from said sump and the liquid aquatron reservoir, said pump being activated when said sensor reads a resistance higher than a threshold resistance.

11. An electrostatographic printing machine, comprising:

a charge retentive surface, capable of movement, advances past a charging station for charging of said charge retentive surface;

an exposure station through which said charge retentive surface moves, said charge retentive surface having charged portions being exposed to a scanning device that discharges said charge retentive surface forming a latent image thereon;

a development station advances toner particles into contact with the latent image on said charge retentive surface as said charge retentive surface moves through said development station;

a transfer station advances a print media for transfer of the toner particles adhered to the latent image onto the print media, the toner particles of the latent image being permanently affixed to the print media via fusing of the latent image of toner particles to the print media;

a condenser device for condensing liquid released by the print media during fusing at said fuser;

a collection member for collecting the condensing liquid;

a measuring device for determining resistance of a liquid concentration in said collection member; and a cleaning station for removal of the toner particles remaining on said charge retentive surface after transfer.

12. An electrostatographic printing machine as recited in claim 11, wherein said condenser device comprises:

a condensing member;

a conduit device located adjacent to said condensing member to enable capture of condensed liquid from said condensing member; and air flow that occurs between said condensing member and said conduit device, said air flow containing the condensed liquid for transport to the collection member.

13. An electrostatographic printing machine as recited in claim 12, wherein said measuring device comprises a sensor.

14. An electrostatographic printing machine as recited in claim 13, wherein said collection member comprises a sump.

15. An electrostatographic printing machine as recited in claim 14, wherein said sensor includes:

a first sensor for determining resistance of liquid concentration in an aquatron liquid reservoir; and a second sensor for determining resistance of liquid concentration in said sump.

16. An electrostatographic printing machine as recited in claim 15, further comprising a pump being connected to said sump and the aquatron liquid reservoir to transport liquid to and from said sump and the aquatron liquid reservoir, said pump being activated when said first sensor reads a resistance higher than a threshold resistance.

17. An electrostatographic printing machine as recited in claim 12, wherein said collection member comprises an aquatron liquid reservoir.

18. An electrostatographic printing machine as recited in claim 17, further comprising a pump being connected to said collection member to remove liquid therefrom, said pump being activated when said sensor reads a resistance higher than a threshold resistance.

19. An electrostatographic printing machine as recited in claim 18, wherein said sensor being located in the aquatron liquid reservoir determines when resistance of a liquid concentration therein reaches a lower critical threshold.

20. An electrostatographic printing machine as recited in claim 18, wherein said sensor being located at an applicator medium contacting an image receptor for determining when resistance of a liquid concentration reaches a lower critical threshold.

21. A method for replenishing an aquatron liquid reservoir in a printing machine, comprising the steps of:

condensing liquid being released by a print media during fusing by a fuser in the printing machine;

collecting the condensing liquid in a collection member; and determining resistance of a liquid concentration in the aquatron liquid reservoir.

22. A method as recited in claim 21, wherein the step of condensing, comprises:

condensing the liquid released by the print media during fusing using a condensing member;

capturing the liquid after condensing from the condensing member in a conduit device located adjacent to the condensing member; and transporting the liquid, after condensing, in an air flow that occurs between the condensing member and the conduit device to the collection member.

* * * * *